US005388049A

United States Patent [19]

Sansone et al.

[11] Patent Number: 5,388,049

[45] Date of Patent: Feb. 7, 1995

[54] VALUE MAIL MONITORING SYSTEM AND METHOD

[75] Inventors: Ronald P. Sansone, Weston; Je H. Oh, Fairfield; William M. Hunt, Shelton, all of Conn.

[73] Assignee: Pitney Bowes Inc., Stamford, Conn.

[21] Appl. No.: 104,686

[22] Filed: Aug. 11, 1993

[51] Int. Cl.[6] ..... G07B 17/00

[52] U.S. Cl. ..... 364/464.02; 364/464.03; 364/478

[58] Field of Search ..... 364/464.02, 464.03, 364/478

[56] References Cited

U.S. PATENT DOCUMENTS 5,119,306 6/1992 Metelits et al. ..... 364/464.02
5,216,620 6/1993 Sansone ..... 364/464.03 X
5,264,665 11/1993 Delfer, III ..... 364/464.03 X

*Primary Examiner*—Edward R. Cosimano
*Attorney, Agent, or Firm*—Ronald Reichman; Melvin J. Scolnick

[57] ABSTRACT

A system and method for providing security to value mail. A mailer produces mail in accordance with a mail list and determines the quantity of mail and weight thereof. A dispatch and routing tag is printed with the destination information, number of mail pieces and weight of the mail. The weight of the mail, number and expected time of arrival are checked at different locations of travel. The mailer and the post office are notified if there is a discrepancy in the number of mail pieces, in the weight of the mail or in the arrival time of the value mail.

15 Claims, 3 Drawing Sheets

VALUE MAIL MONITORING SYSTEM AND METHOD

RELATED CASES

Attention is directed to co-pending U.S. patent application Ser. No. 07/900,397 filed Jun. 18, 1992 entitled Just In Time Mail Delivery System and Method; U.S. Pat. No. 5,119,306 entitled Mail Piece Weight Quality Control System and Method; U.S. Pat. No. 5,329,102 entitled Method and Apparatus for Preparing Validated Mail Tray Labels; U.S. patent application Ser. No. 963,013 filed Jan. 16, 1991 which is now abandoned and now Ser. No. 181,476 and entitled Automated Labeling System which is abandoned and now Ser. No. 08/181,476; and U.S. Pat. No. 5,216,620 and entitled Requesting, Reporting and Verification System and Method for Mail Carrier Payment.

BACKGROUND OF THE INVENTION

In recent years there has been greater cooperation between the postal service, mail equipment manufacturers and large mailers whereby mail can be processed by the mailer so as to decrease the amount of effort on the part of the postal service for delivering mail. The postal service has established a computer based center referred to as "Starships" wherein communication can be had by a large mailer with the postal service for the purpose of exchanging information therebetween. Commercial systems are available such as "Starport" available from Pitney Bowes Inc., whereby large mailers are able to produce mail in a fashion that is helpful to the postal service, and in which communication can be had between the mailer and the postal service to obtain carrier information, scheduling information, quantity and type of mail, and other information that is helpful both to the postal service and to the mailer.

The various systems and methods that have been developed are described in various patents and copending patent applications. In U.S. Pat. No. 5,329,102 a scheme is disclosed whereby mail is processed in such a manner that the mail is sorted to separate the local mail from the non-local mail, the local mail is placed into trays in accordance with their zip codes and a label is printed that identifies the mail in the tray for subsequent processing.

In U.S. Pat. No. 5,329,102, supra, a scheme is disclosed whereby mail is processed in such a manner that the mail is sorted to separate the local mail from the non-local mail, the non-local mail is placed into trays in accordance with their zip codes and a label is printed that identifies the mail in the tray for subsequent processing. As a part of this scheme, the post office is given a running account of the mail being processed so that postage can be accurately determined and the post office is able to process the mail further without having to inspect the same to assure proper payment.

U.S. patent application Ser. No. 181,476, supra, discloses a system whereby labels can be printed by a mailer for the trays and the sacks into which mail is placed for a common carrier, particularly an air carrier. U.S. Pat. No. 5,216,620, supra, discloses a system and method whereby mail that is not addressed locally is conveyed by a mailer to a common carrier. In so doing, the mailer discloses to the local post office information relative to the mail with regard to the number of trays of mail, their weight, their destination and information that may allow the mailer to receive a postal discount for his mail. Upon receipt of the information, the post office would then determine the cost of air freight for the mail which is looked upon by the common carrier as bulk freight.

In copending patent application Ser. No. 07/900,397 and entitled Just-In-Time Mail Delivery System and Method, a description is given whereby a mailer is able to process his mail in such a way that the same is received by the carrier in a timely manner so that the mail does not sit idly for long periods. The mailer has stored in his processor the carrier destination routes thereby allowing the mailer to process batches of mail in accordance with the flight schedules.

Although these prior schemes have contributed to the smoother functioning of the postal service, a problem remains in that there is no effective method in the Starship system for assuring that value mail is not compromised. This is particularly so in the case of the mailing of credit cards. It is recognized that credit card issuers have security systems wherein measures are taken so as to assure that the authorized individual receives a designated credit card. This usually involves mailing of a credit card, the recipient of the credit card being notified separately that a credit card has been mailed and the recipient being given a number to call for confirming receipt. Upon calling that number, the recipient is asked unique questions and upon proper responses, the credit card is activated. This works well, but it is an expensive, time consuming method which does not yield information as to when or how a credit card may have been diverted. It also would be advantageous to have a system and method where a wrongdoer is prevented the opportunity of pilfering credit cards when the same are being processed through the mail delivery system.

SUMMARY OF THE INVENTION

A system and method have been conceived whereby safety measures are taken to assure that value mail, such as the sending of credit cards, is not pilfered. The invention builds upon prior systems that had been developed in the Starship system for the purpose of assisting the postal service in processing mail in a more efficient manner. In such a system, the mailer has a computer wherein mail lists are stored. Mail lists are programmed listings of recipients arranged in accordance with geographical distribution and an itemization of the materials to be received by each recipient is achievable. The mailer will process the mail so as to fill trays in a sorted manner, so that all the mail in a tray will go to a particular destination. After the mail is placed into trays, a destination label is attached to the tray, the tray is placed into a sleeve and the sleeve and tray are weighed. A dispatch and routing tag is then placed upon the sleeve and the sleeve tagged trays are collected in cages sent to the carrier.

In the instant invention, the mailer has a dispatch and routing (D&R) program that will yield the schedule of the common carrier so that the mail that is being processed can be tracked. When mail is identified by the main processor as being value mail, it will be processed in the same manner, but instead of a normal D&R tag being attached to the sleeve, a D&R tag with additional information is placed upon the sleeve. This additional information will include the date and time of delivery to the common carrier and the date and time of expected arrival at the destination, usually a postal distribution center. Prior to the mail being sent from the mailer, the postal service is given the information just recited so that the progress of the mail can be monitored, either by the mailer or by the postal service. In addition, the D&R tag can be of a unique color or combination of colors so that the postal employees are aware that value mail is being processed. At the common carrier of origination, the mail will be weighed to assure that nothing has been removed from the time the value mail has left the mailer to the time it arrives at the common carrier. The mail will be weighed at the postal service destination again to assure that the mail weight is unchanged. In addition to this, the postal service can track the mail to assure that it is received in a timely fashion at all locations. If there is any delay in the delivery of the value mail or there is a discrepancy in the weights, the postal service is alerted that improper events may have occurred. Another parameter that can be used is the number of value mail pieces being shipped.

DETAILED DESCRIPTION OF THE PREFERRED EMBODIMENT(s)

Apparatus and method have been conceived whereby the opportunity for monitoring value mail is afforded. The processing of value mail is carried out in accordance with the destination of that mail, the departure time from the mailer and the estimated times of arrival so that the mail as received by the common carrier and postal distribution centers can be monitored. Sufficient information is given by the mailer to the post office that notifies the post office that value mail is being posted and allows the post office to monitor the mail to assure that the mail is routed in a timely fashion and to assure that the mail weighs the same amount at every mail handling location.

Figure 1:
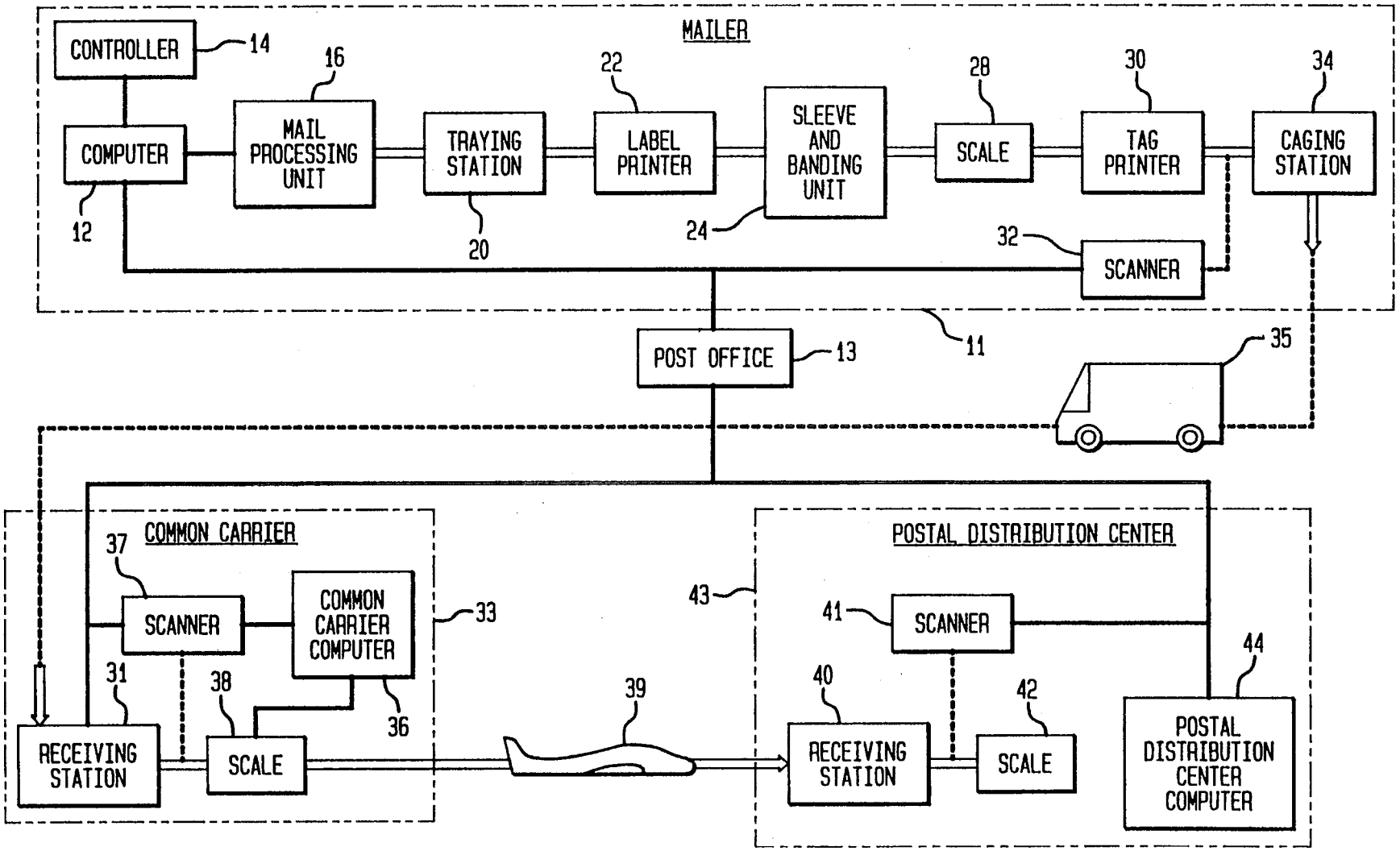
FIG. 1 a block diagram of a system in which the preferred embodiment of the invention can be practiced.

With reference to FIG. 1, a block diagram is shown generally at 10 representing a system capable of practicing the preferred embodiment of the invention. The system 10 includes a mailer's computer 12 that can be any one of a number of commercially available computers such as an IBM Compatible PC 386. This computer 12 is in selective communication with a post office controller 14 and performs accounting and monitoring functions for the post office 13 which will be described hereinafter.

In FIG. 1, the conveyance of mail is indicated by double lines, communication lines are indicated by single lines and optical paths by dotted lines. Although the conveying devices for conveying items from one unit to another are not described, it will be appreciated such devices are well known in the art and of themselves do not form part of the instant invention except to the extent required to perform their normal functions.

The mailer's computer 12 is in communication with a mail processing unit 16 that is a combination of a computer, such as a main frame computer, an inserter, such as a Model Series No. 8300 Inserter, available from Pitney Bowes Inc., a printer and a sorter that sorts mail in accordance with zip codes on the envelopes or in accordance with a program such as Mailer's Choice TM. Inserters of this type have its computer programmed with a mailing list that includes the parties to whom mail is to be sent, the address of the mail recipient and materials to be sent. Such mailing list can be selected by the computer 12 which will select a mailing list for a particular run of mail in response to a request from an operator. Mail lists of this type are commercially available such as FINALIST TM. Sorters that read addresses from envelopes are commercially available and are generally referred to as Optical Character Recognition (OCR) Channel Sorters. Alternatively, a bar code reader can be used if the mail has the Postnet bar code printed thereon. The sorted mail is trayed at a mail traying unit 20 in accordance with its zip code which, of course, represents the destination of the mail.

The mail processing unit 16 conveys information to the computer 12 relative to the mail that is to be placed into trays and the computer controls a label printer 22 for printing an appropriate mail destination label for each tray that is filled. The information conveyed to the computer 12 includes the class of mail, the calculated weight of individual mail pieces, based upon the number and kinds of inserts and number of mail pieces processed, so that the postage can be determined. The destination of the mail is also uploaded to the computer 12. In this manner, a check is made to assure the mail has been processed in accordance with the original instructions. Thereafter, the labels on the trays are scanned as a check to assure they are correct and the trays then go through a sleever and banding unit 24 wherein each tray is placed within a sleeve and then is banded.

As stated previously, after a label is attached to a tray, the label is scanned by a scanner 32 and the data therefrom is received by the computer 12 so that a verification can be made that the data on the label is correct. The computer 12 is programmed with the time of departure and destinations of the vehicles upon which mail is to be placed by a common carrier. The computer 12 makes routing decisions based upon stored information and the destination of the mail in the trays. In addition, the time of departure from the mailer is entered in the computer 12.

Downstream from the sleeving and banding unit 24 is a scale 28 that weighs sleeved and banded trays of mail. Such weight determination will be entered into the computer 12 to be used, in conjunction with the destination data, to calculate the transportation costs of the mail payable to the common carrier. A tag printer 30 is in communication with the computer 12 and is located downstream from the scale 28 for the purpose of printing a dispatch and routing (D&R) tag for giving the common carrier routing information that had been determined by the processor 12, time of departure information, estimated time of arrival at the final destination and the weight as determined by the scale. The D&R tag produced by the tag printer 30 is attached to the opening of the tray sleeve in a manner so that the D&R tag would have to be torn to gain access to the tray in the sleeve. The D&R tag will be described in greater detail hereinafter with reference to FIG. 2. The scanner 32 scans the D&R tag for purposes of verification. The scanner 32 is in communication with the computer 12 to send data relative to the information on the D&R tag. The computer 12 will compare such data with prior calculated data to assure correctness of the data on the D&R tag. Downstream from the scanner 30 is a caging station 34 that includes loading apparatus and a number of receptacles, such as cages, in which trays are placed in accordance with the postal distribution center to which the mail is to be sent. The cages can be any kind of movable container that will hold a large number of trays for subsequent conveyance, thirty three trays being the maximum number to cage.

The mail is accumulated in a cage and is sent to a transporting vehicle, such as a truck 35, where it is transported to the receiving station 31 of a common carrier 33. The time of such departure is entered into the computer 12. The truck 35 can be either a post office truck that is provided to large volume mailers or a truck that belongs to the common carrier or mailer. The common carrier 33 has a computer 36, and a scanner 37 and a scale 38 in communication with the computer for reading the data on the D&R tag and weighing the mail in gross, respectively. The common carrier 33, or postal authorities located at the common carrier, will not be required to sort the trays because of the prior processing by the mailer. The common carrier 33 will place the mail on other transport vehicles such as an airplane 39, train, truck or the like, which will deliver the mail to a receiving station 40 of a postal distribution center 43. The postal distribution center 43 will have a computer 44 which communicates with a scanner 41 and scale 42 for the purpose of scanning the D&R tag and weighing the mail, respectively and a comparison is made by the computer 44 with the same information obtained from the common carrier computer 36 with which it selectively communicates.

Figure 2:
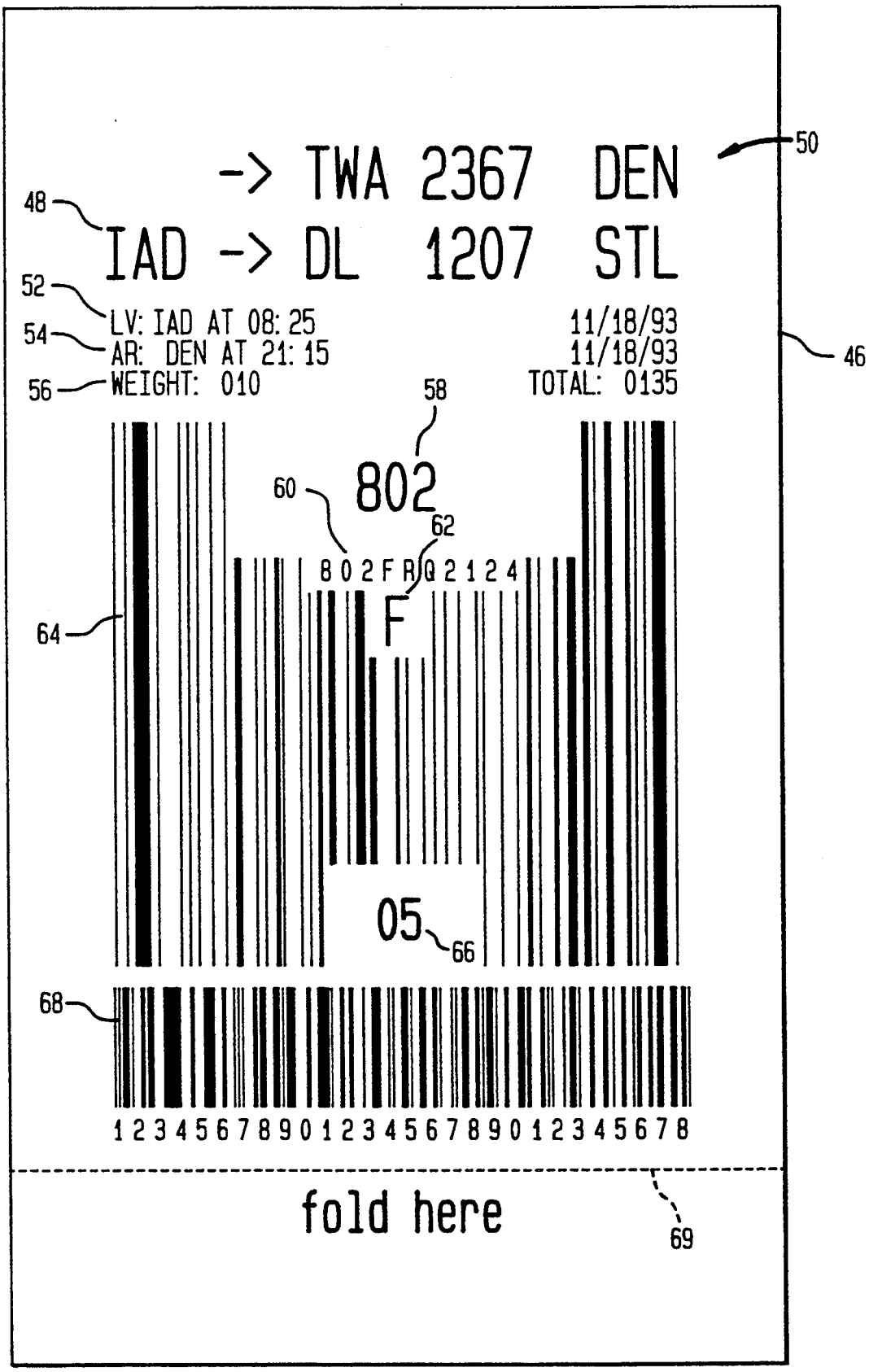
FIG. 2 is a plan view of a D&R tag that has features of the invention for tracking value mail.

With reference to FIG. 2, a D&R tag 46 is shown that incorporates the features of the instant invention. The D&R tag 46 has a first line 48 that indicates the carrier origination information. In this particular instance, a flight will leave from Dulles Airport, IAD to be placed on Delta Airlines flight 1207 for Saint Louis, STL. Above the origination line 48 is the arrival line 50 that indicates that the mail will be received in Denver, DEN, on TWA flight 2367. Below the first two lines is another departure line 52 that gives the time of departure, 8:25 a.m., and the date Nov. 18, 1993. Below that is an arrival information line 54 showing that the flight is due in Denver at 9:15 PM, 21:15 on Nov. 18, 1993. Below that is a data line 56 that gives the weight of the tray, 10 pounds, and the accumulated total weight of the trays placed in a single cage, 135 pounds. A cage will hold up to 33 trays. Assuming that each tray weighs approximately ten pounds the D & R tag 46 of FIG. 2 could be attached to the thirteenth tray placed in a cage. Below these lines 48–56 is a three digit zip 58 indicating the destination of the tray, in this case 802, which is the three digit zip code for Denver. Below the three digit zip 58, is a transportation line 60 that shows the three digit once more and additional information for identifying the mailer. Below the transportation line 60 is a letter 62 that indicates the class of the mail, in this instance the mail being first class mail. Below and around the three digit zip 58 and transportation line 60 is a first bar code symbol 64 that contains the information heretofore recited relative to departure location, time and date, and expected arrival time, date and location. Located at the lower portion of the bar code symbol 64 is a number 66 that indicates that the docket location where the tray of mail is to be delivered at its destination, in this instance docket 5. Below the first bar code symbol 64 is a second bar code symbol 68 which contains security information such as the mailer ID, date and time sealed with the D & R tag, the cage in which is the mail is to be placed, the mail piece identification number and the tray weight. Located below the second bar code symbol 68 is a dotted line 69 indicating where the D&R tag is to be folded in order to properly seal the sleeve into which the tray is placed.

Figure 3:
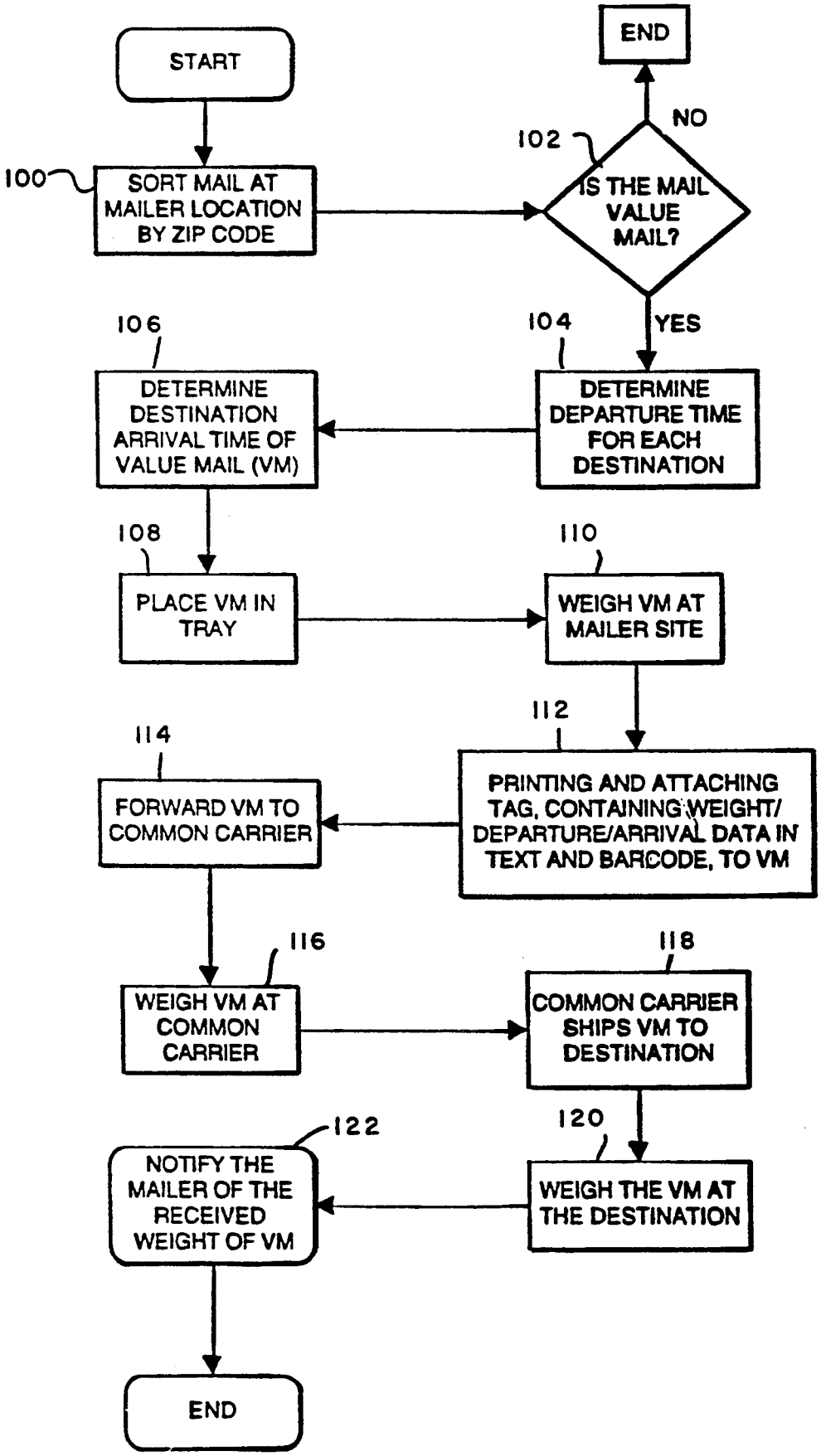
FIG. 3 is a flow chart that describes the process of the instant invention.

In a passive mode of operation, with particular reference to FIG. 3, the computer 12 will be programmed with the route and time of departure of the common carrier airplane 39. The mailer selects the flights on which the mail is to be transported so as to obtain preferred flights with regard to his particular mail runs. The selection will be made so as to eliminate as many stop-overs as possible to obtain direct flights. In fact, the mail can be delayed at the mailer's facility until just before the flight time so that the value mail will not sit idly at a loading dock. The computer 12 of the mail processing unit 16 will contain a mail list for the particular run of mail, and will also have programmed therein the contents that are to be inserted into envelopes by the inserter of the mail processing unit 16 to form mail pieces 100. It will be appreciated that the computer 12 and processor of the mail processing unit 16 could be combined, but in the preferred embodiment mail list and content information is in the processor of the mail processing unit 16 and the computer 12 will contain time of departure 104 information that will be updated as schedules change. The processor 12 will also identify the mail as value mail 102. Value mail is defined as mail that has monetary value to the holder such as credit cards, social security checks, bank drafts and the like. The inserter of the mail processing unit 16 will operate either under command of the computer 12, or its internal processor, and generate the mail pieces in accordance with a programmed mail list so as to address the envelopes and place the value contents therein. After the mail is trayed 108 in accordance with its destination 106, the label printer 22 will print a tray label for the appropriate tray under control of the processor 12 in accordance with the information from the stored mail list. Reference can be had to U.S. Pat. No. 5,329,102, supra, for details as to the manner in which mail pieces are placed into trays in accordance with their zip codes and how the computer 12 coordinates the activities to assure that correct postage is paid, how the requirements of the domestic mail manual are met with regard to postal discounts and how the label printer 22 prints an appropriate label that is placed in or received by a tray.

The labels on the trays are scanned by the scanner 32 and the labeled trays are placed into sleeves and banded by the unit 24. The data resulting from the scanned label is received by the computer 12 to assure the information on the label is correct. The label will have specific information such as location of the postal distribution center 43 to which the mail is sent, the zip code thereof, the tray contents, and the identification of the mailer. It should be noted at this time that the label on a tray is primarily for the benefit of the mail receiving post office for purposes of further sortation and delivery; whereas, the D&R tag 46 on a sleeve is primarily for the benefit of the common carrier 33.

A tray is placed through the opening of a sleeve and banded by the sleeving and banding unit 24. A D&R tag 46 which is referred to as a dispatch and routing tag, has appropriate information printed thereon and by the printer 30 placed 112 on the overlapping portion of sleeve not only to provide information relative routing information to the distribution center 43 to which the mail is to be sent, but also to provide a seal for the sleeve. Before printing the tag, however, the tray is weighed 110. This weighing by the scale 28 is for the purpose of determining the fee due to the common carrier for transporting the mail and to assist in maintaining security for the value mail. Whereas the post office 14 receives the postage due from the mailer based upon individual mail pieces, the common carrier is paid in accordance with the bulk weight of the "freight" and its destination. The tag printer 30 will print the tag under control of the computer 12 that has data resulting from scanning of the tray label, weighing of the tray and destination and routing information received from the computer 14 or from the computer to the mail processing unit.

In the active mode, the postal service 13 will select the flight schedules for the mail in response to the mailer contacting the postal service and informing it as to the destination and quantity of the mail. In this mode, the mailer prints D&R tags and sends information relative to the D&R tags to the post office controller 14. Thereafter, tracking information can be sent by the post office controller 14 to the common carrier 36 and postal distribution center 43.

With reference to FIG. 2 the data printed on the tag will show the departing location 48, location of the postal distribution center 50 to which the tagged mail is to be sent, time and date of departure 52 and expected time of arrival 54, as well as the class of mail of the contents 62 of the tray and the weight 56. Data relative to weight and arrival time can be included in bar code format 64, 68 so that the information can be derived quickly using a bar code scanner. In addition, the identity of the mailer can be included in the bar codes 64, 68.

Again with reference to FIG. 3, after the D&R tag has been scanned by the scanner 32, the information is written into the computer 12 and the trays are sent to the sorting and caging station 34 where they are sorted 102 in accordance with their ultimate destination, i.e. the postal distribution center 43 to which they are to be sent. After sorting, the trays are placed into cages. These cages are then placed on transportation vehicles, such as a truck 35. Thereafter, the cages are sent 114 to a common carrier 38 to be placed upon transportation vehicles, such as an airplane 39, to be sent 118 to a receiving station 40 of a postal distribution centers 43.

At the common carrier 33, the mail is again scanned by the scanner 37 and weighed 116 by the scale 38 to assure the value mail is received in a timely manner and that all the mail has been received, as indicated by its weight. At the postal distribution center 43, the value mail will once more be scanned by the scanner 41 and weighed 120 by the scale 42. If no discrepancy is found the mail will be distributed to local post offices for finer sortation and delivery. If a discrepancy in time or weight is found, the mailer and/or the postal service would be notified 122 and an investigation is initiated to account for the discrepancy.

As a further parameter, the number of mail pieces placed into each tray can be determined by the mail processing unit 16 and the number of mail pieces in trays can be sent to the common carrier 33 and postal distribution centers 43. If a weight or time discrepancy is found, either would have the option to count the number of mail either in a tray as a further check.

Thus, what has been shown and described is an apparatus and method whereby security is provided to value mail by the repeated, monitoring of the parameters of the mail. These parameters are printed on a D&R tag so that the value mail can be inspected along its path of travel. In this way, one is assured that the mail arrives intact and on time at its destination.

The embodiments disclosed herein have been given by way of illustration only, and other embodiments of the instant invention will be apparent to these skilled in the art from a consideration of the description. Limitations on the instant invention are to be found only in the claims.

What is claimed is:

1. A system for processing value mail, comprising:

computer means, means for identifying value mail, means in communication with said computer means for sorting value mail in accordance with its destination, means for traying the value mail sorted by said sorting means in accordance with its destination, means for weighing value mail trayed by said traying means, means for delivering mail trays weighed by said weighing means to a common carrier, said computer means having mail lists and time of departure and arrival data for a transportation system, and printer means in connection with said computer means for printing a dispatch and routing tag including routing, distribution, weight and time information thereon relative to departure and expected time of arrival of said value mail.

2. The system of claim 1 further including means for placing labels on trays, means for placing said labelled trays into sleeves and means for banding sleeved trays.

3. The system of claim 1 including means for providing communication between a post office and said computer means.

4. The system of claim 1 including means for identifying said value mail as priority mail.

5. The system of claim 1 wherein said tag has the identification of the mailer printed thereon.

6. The system of claim 1 including means for printing an accumulated weight on said dispatch and routing tag for a series of trays.

7. A system for processing value mail including computer means, sorting means in communication with said computer means for sorting mail, traying means for traying value mail sorted by said sorting means, printing means in communication with said computer means for printing mail distribution labels to accompany the mail trays trayed by said traying means, means for delivering trays labeled by said labeling means to a common carrier and first means for weighing the mail, said computer means having time of departure and time arrival data for a transportation system and further including means for printing a dispatch and routing tag that includes identification of the mailer, mail weight information and routing and destination information relative to the mail, a second computer means in communication with and remote from said first computer means and second weighing means in communication with said second computer means remote from said first computer means and said first weighing means.

8. In a method of processing value mail including the steps of having a mailer sort the value mail in accordance with the zip code designation thereof, traying the value mail and providing value mail destination data to the mail trays, the improvement comprising the steps of:

a) identifying the presence of value mail in a mail processing system, b) determining the routing of the mail trays through a transportation system, c) determining the expected times of departures and arrival of the mail through the transportation system, d) weighing the mail trays, e) printing a dispatch and routing tag with weight and expected time of arrival information thereon, f) delivering mail to a common carrier with the dispatch and routing tag accompanying the value mail g) weighing the value trays at the common carrier, and h) communicating to the mailer the time of arrival and weight of the value mail at the common carrier.

9. In a method of processing value mail, the steps comprising:

a) determining the presence of value mail in a mail processing system;

b) determining the time for value mail to arrive at a destination;

c) determining the weight of the mail;

d) printing a bar code on the tag indicating the weight of the valve mail;

e) printing the expected time of arrival at a destination on the tag bar code;

f) delivering the value mail to a common carrier;

g) weighing the mail at the common carrier; and h) communicating to the mailer the weight of the value mail received by the common carrier.

10. The method of claim 9 further including counting the number of value mail pieces sent by a mailer to a common carrier and counting the number of value mail pieces received by the common carrier.

11. In a method of processing value mail, the steps comprising:

a) sorting mail at a mailer location in accordance to their zip codes, b) determining the departure time for each mail destination at the mailer location, c) determining the time for the value mail to arrive at a destination, d) weighing the value mail at the mailer location, e) attaching a tag to the value mail containing weight information and information relative to the time of departure from the common carrier and expected arrival time of the value mail at each destination, f) forwarding the value mail to a common carrier, g) weighing the value mail at the common carrier, h) shipping the value mail to the destinations, of the value mail, and i) weighing the value mail at the destinations.

12. The method of claim 11 including the step of determining if a value mail has been delivered at its destination at the expected arrival time on the tag.

13. The method of claim 11 including the step of the common carrier notifying the mailer as to the weight of value mail received by the common carrier.

14. In a method of processing value mail, the steps comprising:

a) determining the presence of value mail in a mail processing system;

b) determining time value mail is due to arrive at a plurality of destinations;

c) fetching flight data for the value mail for the destination;

d) determining the weight of the value mail;

e) printing a bar code, on a tag indicating the weight of the value mail;

f) printing the expected times of arrival at a plurality of destinations on the tag bar code;

g) sending the value mail to a common carrier;

h) determining the weight of the value mail at the common carrier;

I) processing the value mail at the common carrier for delivery to the destination; and j) shipping the value mail after processing is complete at the common carrier to the destinations.

15. The method of claim 14 further comprising the step of weighing the mail at the destinations, comparing the weight of the value mail at the destinations with the weight of the value mail at the common carrier, determining if there is a discrepancy in the destination weight with the common carrier weight and notifying the postal service if a discrepancy is found.

* * * * *